US007475855B2

(12) United States Patent
Padiak et al.

(10) Patent No.: US 7,475,855 B2
(45) Date of Patent: Jan. 13, 2009

(54) SIGN MOUNT WITH UNPINNED HINGE

(75) Inventors: Scott Padiak, Glencoe, IL (US); Paul C. Evans, Chicago, IL (US); Jeffrey C. Ouyang, Chicago, IL (US)

(73) Assignee: Cormark, Inc., Des Plaines, IL (US)

( * ) Notice: Subject to any disclaimer, the term of this patent is extended or adjusted under 35 U.S.C. 154(b) by 237 days.

(21) Appl. No.: 11/188,384

(22) Filed: Jul. 25, 2005

(65) Prior Publication Data

US 2007/0028492 A1 Feb. 8, 2007

(51) Int. Cl.
*A47F 5/00* (2006.01)

(52) U.S. Cl. ..... 248/122.1; 248/289.11; 248/289.12; 40/492; 40/608

(58) Field of Classification Search ..... 248/289.11, 248/122.1, 282.1, 492.14, 292.13, 900, 289.12, 248/417; 40/492, 608, 642.02, 658, 647, 40/61.03

See application file for complete search history.

(56) References Cited

U.S. PATENT DOCUMENTS

| | | | | | |
|---|---|---|---|---|---|
| 1,273,696 | A * | 7/1918 | Vanhoof | 248/145 |
| 2,532,996 | A * | 12/1950 | Clark et al. | 16/281 |
| 2,550,338 | A * | 4/1951 | Dunagan | 248/145 |
| 2,602,684 | A * | 7/1952 | Pinke | 403/53 |
| 4,473,868 | A * | 9/1984 | Moore | 362/485 |
| 4,593,879 | A * | 6/1986 | Seely et al. | 248/624 |
| 4,676,015 | A * | 6/1987 | Stoudt | 40/608 |
| 4,737,048 | A * | 4/1988 | Herrstrom | 403/229 |
| 4,805,331 | A * | 2/1989 | Boggess et al. | 40/651 |
| 5,437,409 | A * | 8/1995 | Coushaine | 232/39 |
| 5,560,583 | A * | 10/1996 | Holmgren | 248/652 |
| 5,617,661 | A * | 4/1997 | Mason | 40/642.01 |
| 6,964,399 | B1 * | 11/2005 | O'Neill | 248/292.13 |
| 7,090,182 | B2 * | 8/2006 | O'Neill | 248/289.11 |
| 7,163,142 | B2 * | 1/2007 | DeLine et al. | 232/39 |
| 2002/0073588 | A1 * | 6/2002 | Reynolds et al. | 40/642.02 |
| 2003/0079391 | A1 * | 5/2003 | Reynolds et al. | 40/642.02 |
| 2004/0060218 | A1 * | 4/2004 | Reynolds et al. | 40/642.02 |

* cited by examiner

*Primary Examiner*—Kimberly T Wood
(74) *Attorney, Agent, or Firm*—Levenfeld Pearlstein, LLC

(57) ABSTRACT

A mount for mounting a sign to the post of an associated structure includes a base element fixedly mounted to the post that defines a hinge region and a base plane, and a support arm having a shoulder mounted at the shoulder to the base element. The support arm is pivotable about the base element between a first position parallel to the base plane and a second position transverse to the base plane. A pair of springs extend between and connect the base element and the support arm. The base element and the support arm are engaged with one another, and are maintained engaged with one another, only by the tension of the springs.

13 Claims, 6 Drawing Sheets

SIGN MOUNT WITH UNPINNED HINGE

BACKGROUND OF THE INVENTION

The present invention is directed to a sign mount. More specifically, the present invention is directed to a rugged sign mount that has an unpinned hinge and that uses tensioned bands to secure the support arm to the mount base and to realign the arm after the arm has been moved off center.

Signs and more particularly, point of purchase signs or display systems, when properly designed, can be tremendously effective marketing tools. These systems have become widely popular in all manners of retail trade.

In one common use, signs are mounted to shelving systems that permit loading of pallets and palletized items onto the shelves. These are commonly referred to as pallet racks. These arrangements permit the storage of large items and large amounts of items on each of the shelves. However, the shelves do not typically lend themselves to the mounting of point-of-purchase displays or signs. In addition, as the name suggests, pallets may be loaded onto these racks. Pallets are typically loaded onto and removed from the shelf systems by forklifts or like equipment.

Many known signs are permanently or semi-permanently affixed to the shelves and are hung above, below or along support beams (vertical uprights) on the sides of the shelving systems. While these signs function well to direct a consumer's attention to the particular products, they do not permit ready access to the shelves to, for example, restock the shelves or retrieve items therefrom. This, of course, is particularly true of those signs that are permanently or semi-permanently affixed to the shelves.

Known mounting systems include those disclosed in Padiak et al, U.S. Pat. No. 5,934,633 entitled "Pivotal, Two-Position Locking Sign Mounting System" and Conway et al., U.S. Pat. No. 6,484,988 entitled "Bias-Assisted Sign Mount", both of which are commonly assigned with the present application and are incorporated herein by reference.

However, one drawback to these systems is that the sign mounts all use pinned or fixed pin hinges about which the support arm pivots, and these arms (and the pivots) can be damaged if struck or if a large enough force moves the display arm in a direction other than the pivoting direction.

Accordingly, there is a need for a sign mount that is rugged yet light-weight. Desirably, such a mount allows the support arm to be moved off center (in a direction other than a pivot direction) by a force without damaging the sign mount. Most desirably, in such a system the arm realigns with the mount once that force has been removed.

BRIEF SUMMARY OF THE INVENTION

A mount for mounting a sign to the post of an associated structure includes a base element and a support arm mounted to the base element. The sign mount is rugged yet light-weight and allows the support arm to be moved off center (in a direction other than a pivot direction) by a force without damaging the sign mount. Once that force has been removed, the arm realigns with the mount.

The base element is mountable (and fixed) to the post. The base defines a hinge region and further defines a base plane. The base is mounted to the post by a bracket.

The support arm has a shoulder and is mounted at the shoulder to the base element hinge region. The support arm is pivotable about the base element between a first position parallel to the base plane and a second position transverse to the base plane.

A pair of tension biasing elements (springs) extend between and connect the base element and the support arm. The base element and support arm are engaged with one another, and are maintained engaged with one another, only by the tension of the biasing elements. That is, there are no pins that are common to the base and arm.

In a preferred embodiment, the base element hinge region includes a resting surface and a pivot surface and the support arm shoulder includes a resting face. The arm and base faces cooperate with one another when the support arm is in the first position parallel to the base plane.

A present base element is substantially symmetrical about a plane through the base element that is perpendicular to the base plane. In this manner, the element is engages two support arms in opposing relation to one another. A central region is formed between the hinge regions for receiving the support arms when in the second position.

The springs are mounted to the base element inwardly of and spaced from the resting face. The springs are mounted to the base by pins to permit the springs to rotate as the support arm is rotated. Slots can be formed in the resting face through which the springs pass. The support arm shoulder also includes slotted openings that align with the base slots for passage of the springs.

To facilitate realignment of the arm after is it moved (both in and out of the pivoting direction), springs extend between the base element and the support arm at an angle $\alpha$ to the horizontal. Preferably, the springs are disposed in mirror image relation to one another above and below the horizontal, and are at an angle greater than zero degrees and less than ninety degrees to the horizontal, and most preferably at an angle of about ten degrees to the horizontal.

To affix a sign or display to the mount, the support arm includes a display arm mounted to the shoulder.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
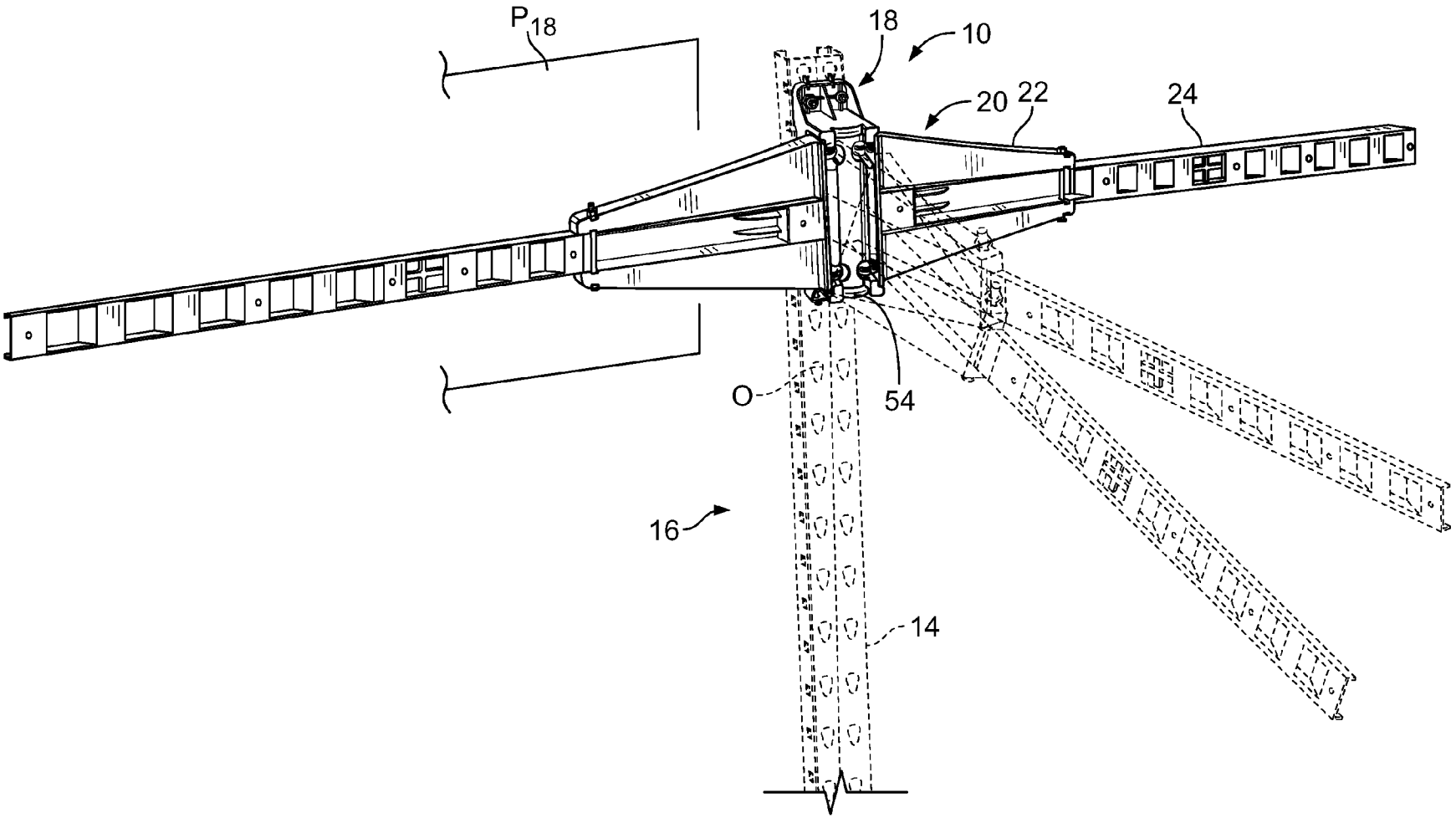
FIG. 1 is a perspective view of a sign mount with an unpinned hinge embodying the principles of the present invention, the mount shown with two arms in a display position in solid lines and in a folded or access position in shadowed or dashed lines, and with the mount illustrated mounted to a vertical upright post.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Figure 6:
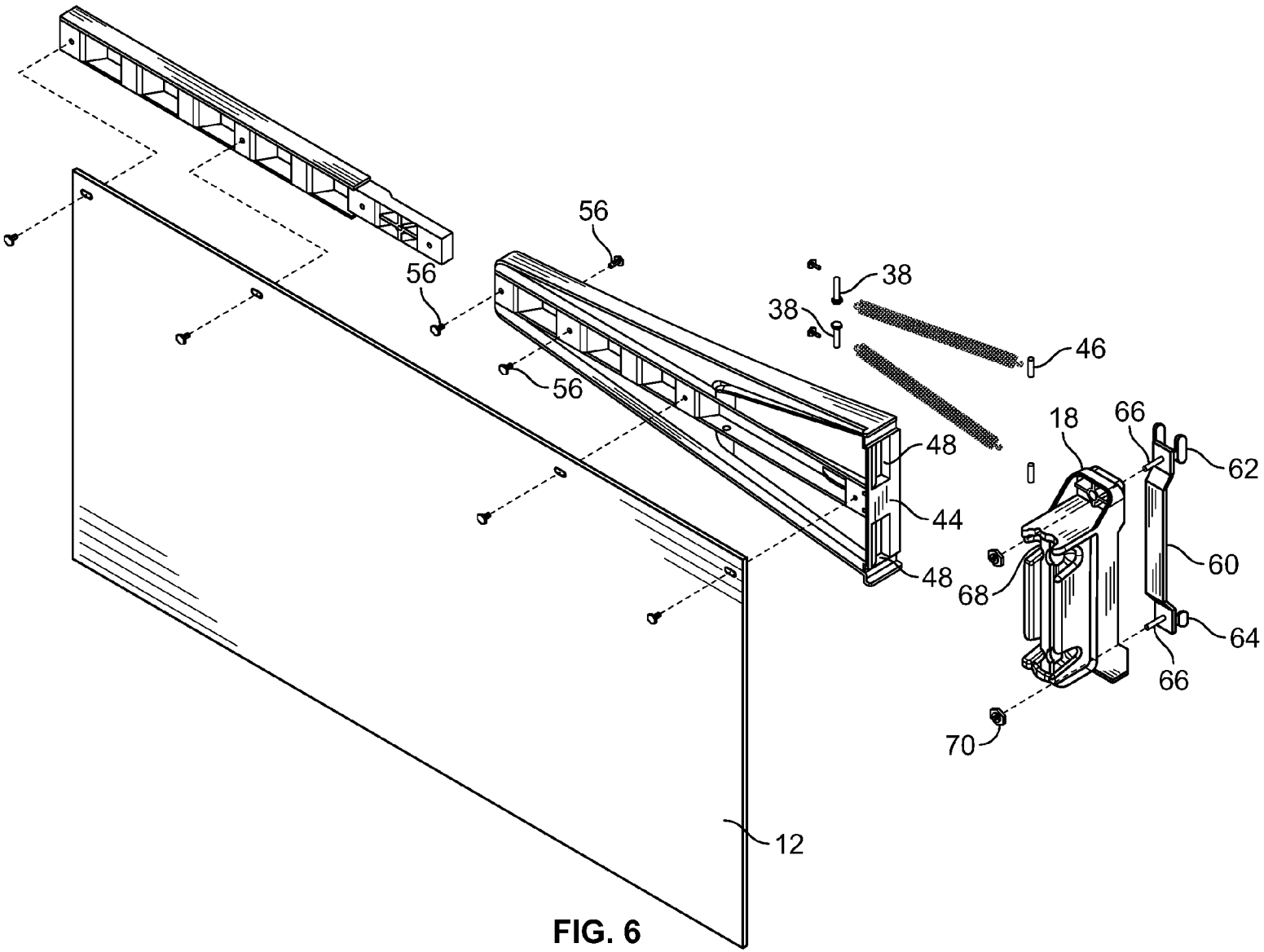
FIG. 6 is an exploded view of one embodiment of the mount and one support arm and display.

Referring now to the figures, and in particular to FIG. 1, there is shown an embodiment of the sign mount with unpinned hinge 10 embodying the principles of the present invention. The mount 10 is shown configured for mounting a sign or display 12 to a vertical upright or post 14 (see FIG. 6), such as that associated with a pallet rack 16 or the like.

The mount 10 includes a stationary base element 18 that is affixed to the post 14 and a support arm 20 that is mounted to the base 18. The base 18 defines a base plane $P_{18}$ that is parallel to the pallet rack or storage system 16 to which the sign mount 10 is affixed. The support arm 20 includes a shoulder portion 22 and a display arm 24 fixedly mounted to the shoulder 22. The support arm 20 is mounted to the base 18 by biasing elements 26, such as the illustrated pair of coil springs 26*a,b*.

The base 18 includes a mounting portion 28 that rests against and is fastened to the post 14, and a hinge region 30. In a present embodiment, the base 18 is formed so as to support a pair of support arms 20 and is essentially symmetrical about a central plane $P_{28}$. To this end, the base 18 includes a pair of hinge regions 30*a,b* (one on either side of the plane $P_{28}$), each of which includes a flat resting surface or face 32 and a pivot surface 34.

The base 18 further includes a pair of securing regions 36 one each at about the upper and lower ends of each face 32 that are adapted to receive and secure the springs 26. In a present embodiment, the springs 26 are mounted to the base 18 by pins 38 to allow the springs 26 to pivot at the base 18. This minimizes any contortion or twisting of the springs 26, but allows tensioning the spring 26 (without twisting) as the arm 20 is pivoted between the display and access positions. The securing regions 36 can include slots 40 through which the springs 26 pass, so that the springs 26 are pinned inwardly of the resting face 32 and the pivot surface 34, relative to the support arm 20.

As set forth above, the support arms 20 each include a shoulder 22 and a display arm 24 fixedly mounted to the shoulder 22. The shoulder 22 includes a resting surface 44 that cooperates with the base resting face 32 (or surface) when the sign 12 is in the display position (as shown in solid lines in FIG. 1). In this manner with the two facing surfaces 32, 44 engaging one another the arm 20 is stable when the sign 12 in the display position.

The springs 26 are mounted to the support arm 20 at a location along the support arm 20, outward of and spaced from the resting surface 44. In a present mount, the springs 26 are mounted to the support arm 20 along the shoulder 22, near a transition of the shoulder 22 to the display arm 24. The springs 26 are affixed to the support arm 20 by pins 46 to permit readily removing and/or replacing the support arms 20 or springs 26. As illustrated, the shoulder resting face 44 includes slotted openings 48 through which the springs 26 pass from the base 18 to the point at which the springs 26 are affixed to the support arm 20 (as at the pins 46). The openings 48 maintain the springs 26 properly positioned between the base 18 and the support arm 20 and further maintain the support arm 20 mounted to the base 18.

The springs 26 are maintained in tension when the support arm 20 is mounted to the base 18, regardless of whether the arm 20 is in the display position (FIG. 1, solid lines) or the access position (FIG. 1, phantom lines). Because of the mating surfaces 32, 44, the tensioned springs 44 maintain the support arm 20 in the display position. In a present embodiment, the base surfaces 32 are within a slight recessed area 42 which further provides stability for the shoulder 22 resting on the base 18.

Figure 2:
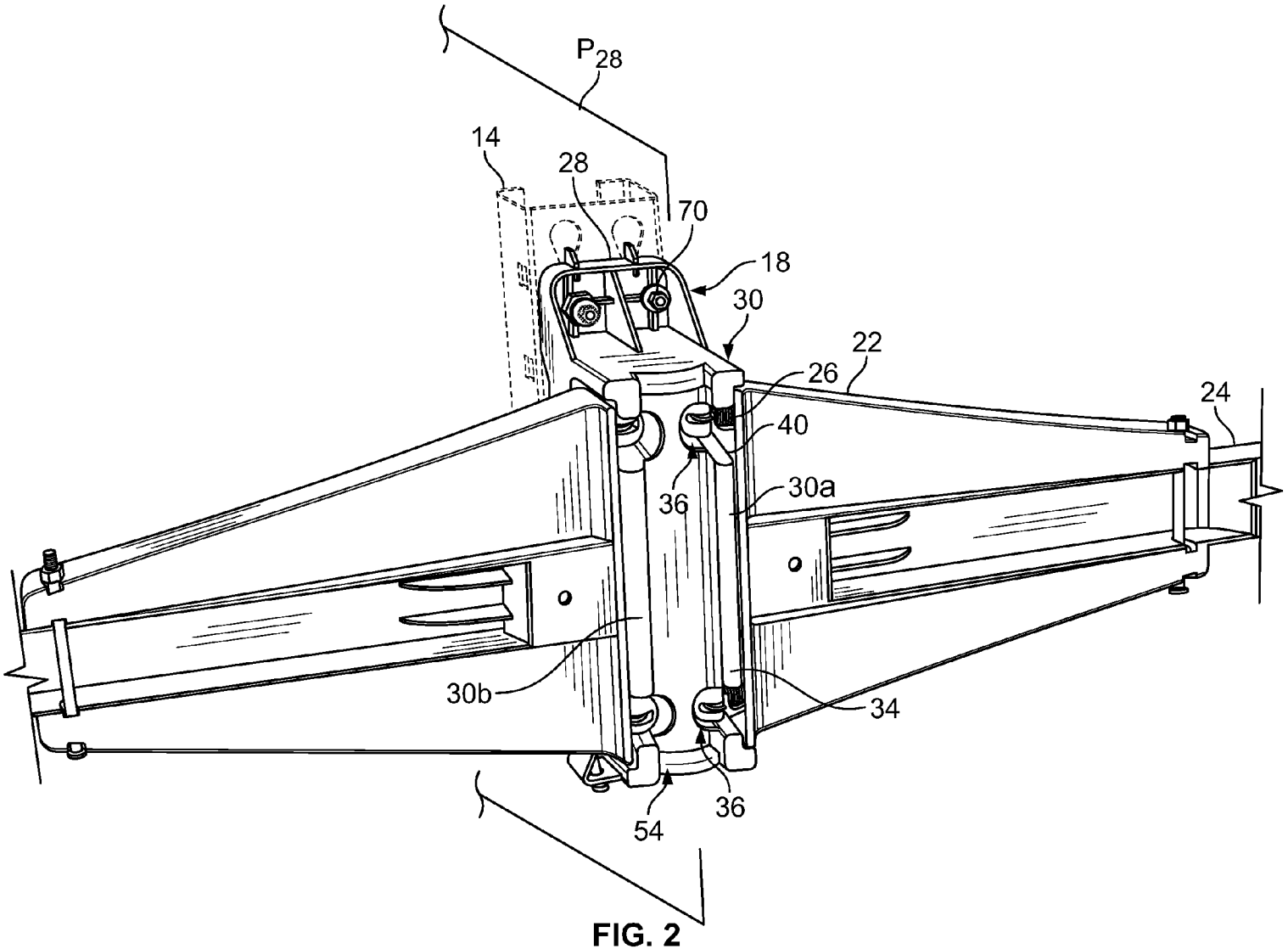
FIG. 2 is a partial close-up view of a mount and a pair of support arm shoulders, the arms being in a display position and again shown with the vertical upright post in shadowed lines.

As seen in FIG. 2, the central portion 54 of the base 18, between the pivot surfaces 34*a,b* is also recessed. In this manner, when either (or both) of the support arms 20 is rotated toward the center (toward the access position), the shoulder surface 44 rests in the central region 54. This permits a stable or secure location for the arm 20 when in the access position.

Figure 3:
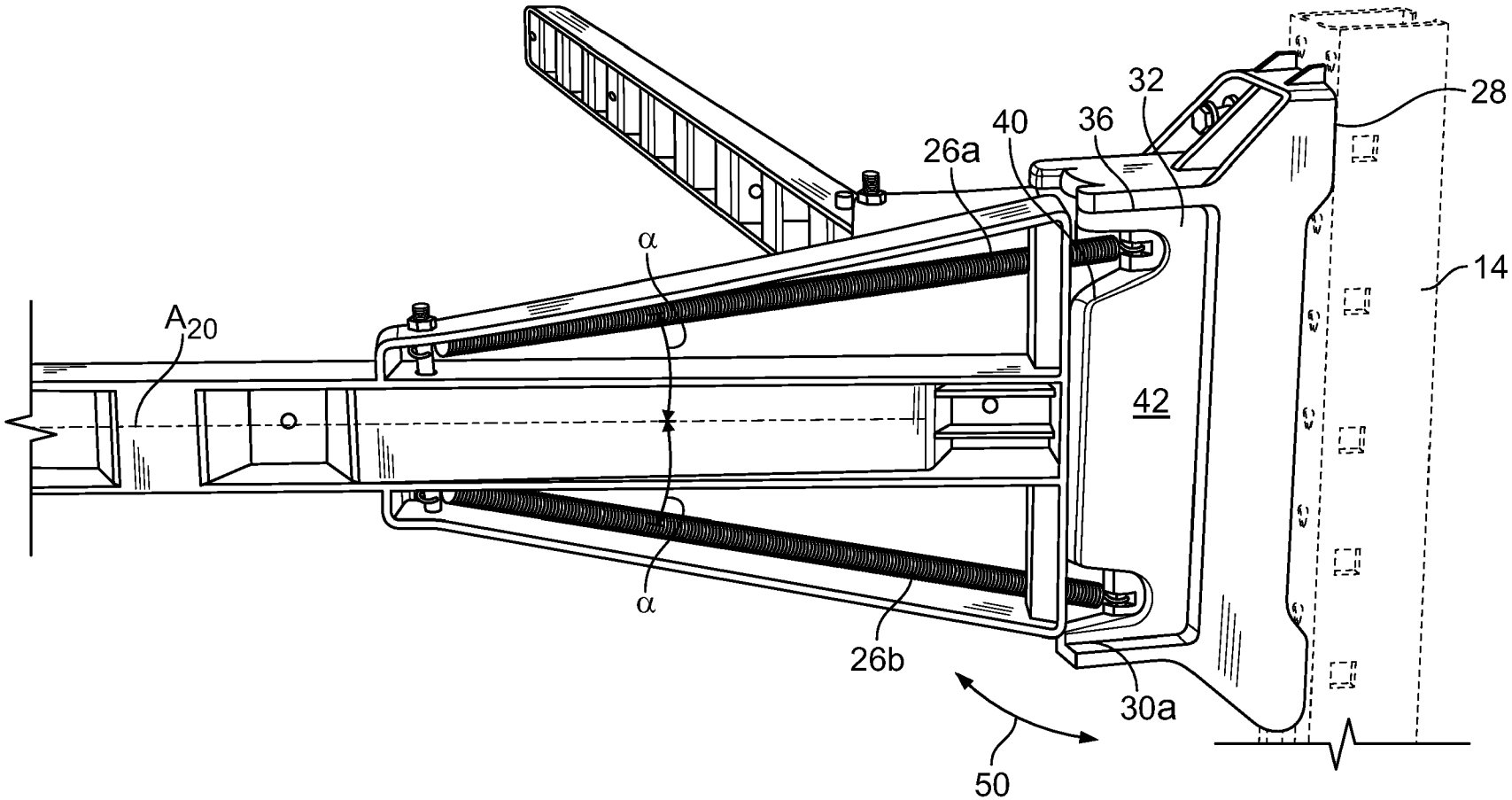
FIG. 3 is a side view of the mount and arm.
Figure 4:
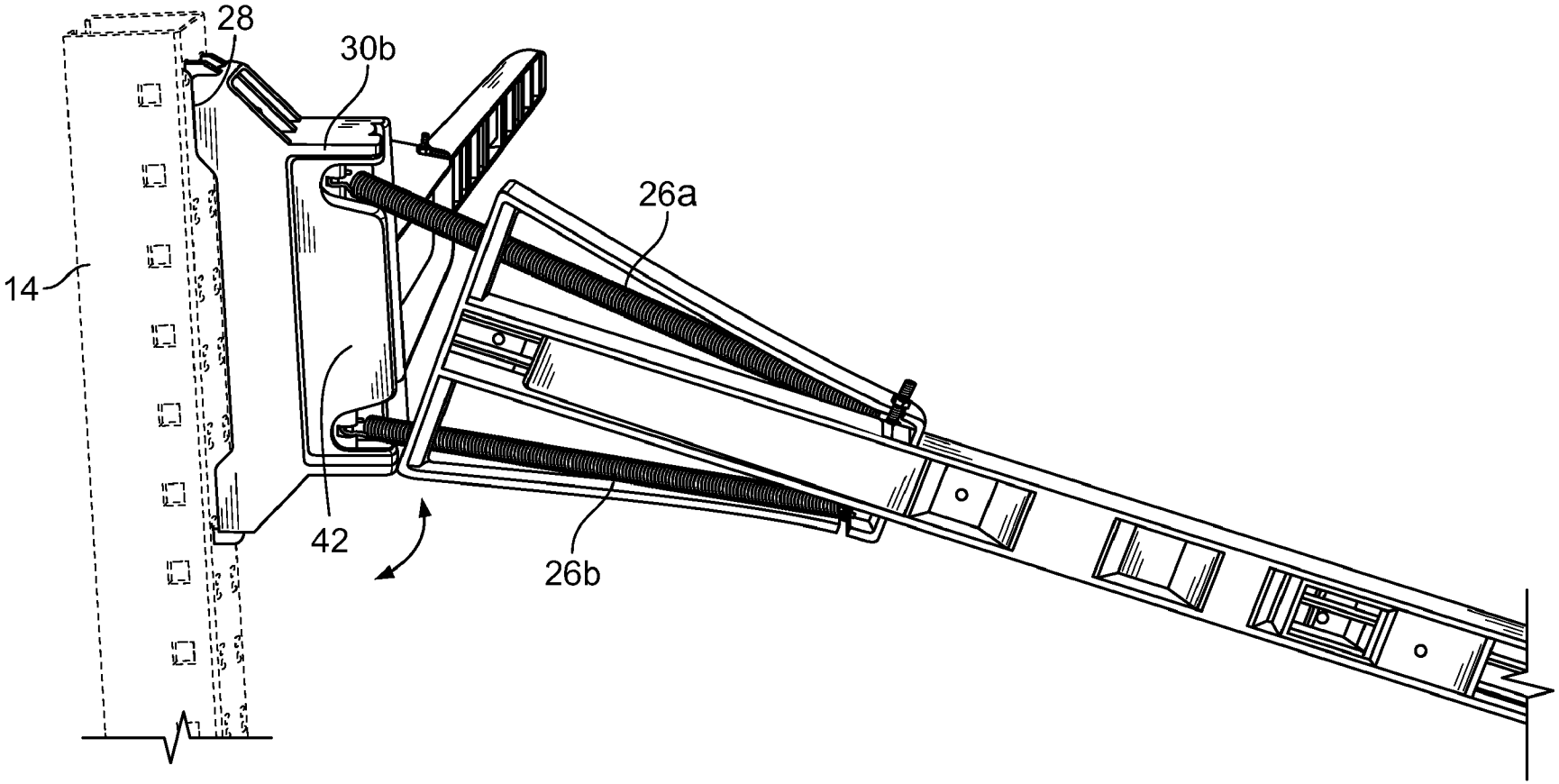
FIG. 4 illustrates an arm that has been moved in a direction other than the pivot direction (the arm is shown pulled downward)
Figure 5:
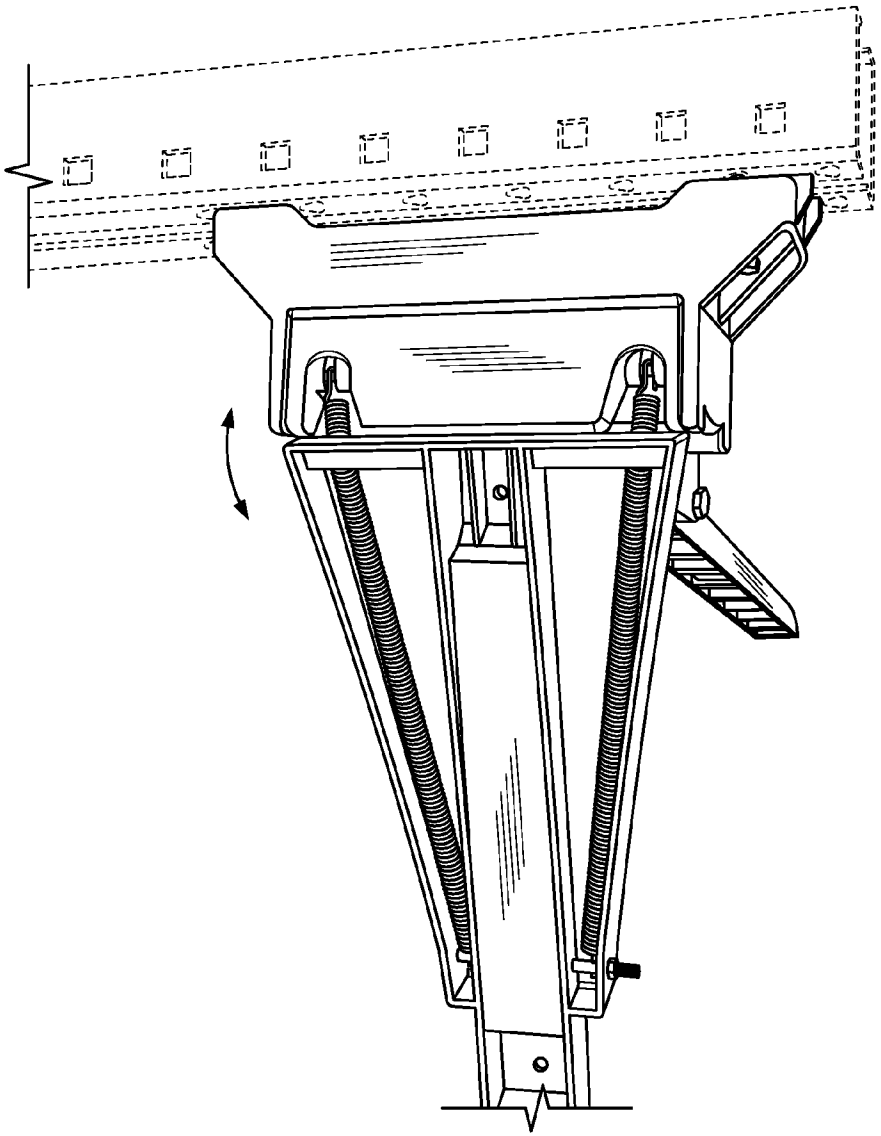
FIG. 5 is a view of the arm that is over pivoted from the display position to the access position.

As is seen in FIGS. 3-5, the springs 26 are mounted between the base 18 and the support arm 20 such that one of the springs 26*a* forms an angle $\alpha$ between zero and ninety degrees above a center line or axis $A_{20}$ of the arm 20 and the other spring 26*b* forms an angle $\alpha$ between zero and ninety degrees below the center line $A_{20}$ of the arm 20. In a present arrangement, the springs 26 are mounted at an angle $\alpha$ of about 10.3 degrees to (above and below) the centerline $A_{20}$ (or to horizontal for a horizontally oriented sign 12). This angled connection facilitates the tension of the springs 26 realigning the support arm 20 if the sign 12 or arm 20 is urged or struck (e.g., pulled or pushed) in a direction other than the pivoting direction (other than horizontal movement), for example, as illustrated in FIG. 4. The rolled edge (in conjunction with the recess at the face 42) at about the pivot surface 34 facilitates readily moving the support arm 20 between the display position and the access position and maintaining the support arm 20 in the desired position.

The display arm 24 can be formed as a separate element that is mounted to the shoulder 22 by, for example fasteners 56. This facilitates readily adapting the display arm 24 to any desired use (e.g., size or shape). This also permits the use of a single base 18 and shoulder 22 configuration with any of a number of display arms 24 (or other display) designs.

The base 18 can be mounted to the vertical upright post 14 in any recognized manner. In a present embodiment, the base 18 is mounted to the post 14 by a bracket 60 having upper and lower retaining tabs 62, 64, respectively, that insert into openings O in the post 14 and engage an inner surface (not shown) of the post 14. A pair of threaded stubs 66 extend from the bracket 60 from a side opposite of tabs 62, 64. The stubs 66 extend through openings 68 in the base 18 for securing the base 18 to the bracket 60 by, for example, threaded nuts 70. The base 18 and bracket 60 are configured such that the base 18 rests against the post 14 and the bracket 60 resides within the base 18. As the nuts 70 are tightened onto the stubs 66, the base 18 is pulled to the post 14 and the bracket 60 is pulled tighter to the base 18. This snugs the tabs 62, 64 up to the inside of the post 14 to secure the base 18 to the post 14.

In a present embodiment, the mount 10 is formed from a polymeric (plastic) material. It is contemplated that the various parts are injection molded, however, other fabrication methods can also be used.

It will be appreciated that the present sign mount 10, having an unpinned hinge is more durable than known sign mounts. That is, because the hinge is formed from a stationary element (base 18) and a moving element (support arm 20) that are connected to one another only by springs (rather than a pin), there are no "deformable" elements such as hinge pins or pintles connecting the two parts (the base 18 and the arm 20) to bend or that are bent as part of the support. Those skilled in the art will appreciate that by not rigidly attaching the support arm 20 to the base 18, the arm 20 can be moved off center, that is pulled up or down or even pulled away from the base 18, without damaging the structure of the mount 10 or sign 12. The springs 26 will tend to realign the arm 20 to the base 18 when that force is removed.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover all such modifications as fall within the scope of the disclosed, exemplary embodiment.

The invention claimed is:

1. A mount for mounting a sign to a post of an associated structure, comprising:

a base element mountable to the post, the base element defining a pair of hinge regions, the base element defining a base plane;

two support arms;

at least two tension biasing elements connecting each of the support arms to the base element;

wherein each of the support arms is engaged with the base element, and is maintained in engagement with the base element only by tension of the biasing elements;

each of the support arms being pivotable about a respective one of the hinge regions between a first position parallel to the base plane and a second position transverse to the base plane;

each of the hinge regions comprising a resting surface, and the base element comprising a central region between the hinge regions;

each of the support arms comprising a resting face configured to cooperate with the respective hinge region resting surface when the respective support arm is in the first position parallel to the base plane, and to cooperate with the central region when the respective support arm is in the second position transverse to the base plane, wherein the biasing elements for the support arms are springs and wherein the springs are mounted to the base element inwardly of and spaced from the resting surface of the hinge region about which said one of the support arms is pivotable, wherein said one of the support arms includes slotted openings therein and wherein the springs are disposed through the slotted openings.

2. The mount in accordance with claim 1, wherein the springs are mounted to the base element by pins to permit the springs to rotate as said one of the support arms is rotated between the first and second positions, and wherein the base element includes slots for receiving the springs, and wherein said one of the support arms includes slotted openings therein in alignment with the base element slots and wherein the springs are disposed through the slotted openings and the base element slots.

3. The mount in accordance with claim 1 including a bracket for securing the base element to the post.

4. The mount in accordance with claim 1 wherein the springs are at an angle greater than zero degrees and less than ninety degrees to the horizontal.

5. The mount in accordance with claim 4 wherein the springs are at an angle of about ten degrees to the horizontal.

6. The mount in accordance with claim 1 wherein one of the support arms includes a display arm mounted to a shoulder, the shoulder comprising the resting face of said one of the support arms.

7. The mount in accordance with claim 1 wherein the springs are mounted to the base element by pins to permit the springs to rotate as said one of the support arms is rotated between the first and second positions.

8. A mount for mounting a sign to a post of an associated structure, the mount comprising:

a base element mountable to the post;

a first support arm structured and dimensioned for supporting the sign;

at least two tension biasing elements extending between and connecting the base element and the support arm;

the support arm being engaged with the base element, and being maintained in engagement with the base element, only by tension of the biasing elements;

the base element defining a base plane, and comprising a generally planar central surface parallel to the base plane and a generally planar resting surface transverse to the base plane;

the support arm comprising a generally planar resting face;

the support arm being pivotable between first and second stable positions relative to the base element;

wherein, when the support arm is in the first stable position, the support arm resting face is maintained parallel to and engaged flatly against the base element resting surface;

wherein, when the support arm is in the second stable position, the support arm resting face is maintained parallel to and engaged flatly against the base element central surface.

9. The mount in accordance with claim 8, the biasing elements comprising springs;

the springs being disposed in mirror image relation to one another above and below the horizontal.

10. The mount in accordance with claim 8, the biasing elements comprising springs;

each of the springs extending between the base element and the support arm at an angle to the horizontal.

11. The mount in accordance with claim 8, the biasing elements comprising springs;

the base element comprising slots;

the springs being disposed respectively through the slots and mounted to the base element behind and spaced from the resting surface and the central surface.

12. The mount in accordance with claim 8, the biasing elements comprising springs;

the support arm comprising slotted openings;

the springs being disposed respectively through the slotted openings and mounted to the support am behind and spaced apart from the resting face.

13. The mount in accordance with claim 8, further comprising:

a second support arm;

the base element being substantially symmetrical about a plane through the base element that is perpendicular to the base plane;

the base elements being configured to engage the first and second support arms in opposing relation to one another.

* * * * *